US012471745B2

(12) United States Patent
Klacking

(10) Patent No.: US 12,471,745 B2
(45) Date of Patent: Nov. 18, 2025

(54) VACUUM ASSEMBLY

(71) Applicant: SlurryMonster, LLC, Livonia, MI (US)

(72) Inventor: Ryan Klacking, Canton, MI (US)

(73) Assignee: SlurryMonster, LLC, Livonia, MI (US)

( * ) Notice: Subject to any disclaimer, the term of this patent is extended or adjusted under 35 U.S.C. 154(b) by 0 days.

(21) Appl. No.: 18/151,281

(22) Filed: Jan. 6, 2023

(65) Prior Publication Data

US 2024/0225384 A1 Jul. 11, 2024

(51) Int. Cl.

| | |
|---|---|
| ***A47L 7/00*** | (2006.01) |
| ***A47L 9/00*** | (2006.01) |
| ***A47L 9/06*** | (2006.01) |
| ***A47L 9/12*** | (2006.01) |
| ***A47L 9/28*** | (2006.01) |
| ***F04D 25/06*** | (2006.01) |

(52) U.S. Cl.

CPC ..... *A47L 7/0038* (2013.01); *A47L 9/009* (2013.01); *A47L 9/066* (2013.01); *A47L 9/12* (2013.01); *A47L 9/2868* (2013.01); *F04D 25/06* (2013.01)

(58) Field of Classification Search

CPC ..... A47L 7/0038; A47L 9/009; A47L 9/066; A47L 9/12; A47L 9/2868; A47L 7/0004; F04D 25/06

See application file for complete search history.

(56) References Cited

U.S. PATENT DOCUMENTS

| | | | | |
|---|---|---|---|---|
| 3,431,582 A * | 3/1969 | Grave | A47L 11/4088 | 15/353 |
| 4,755,194 A * | 7/1988 | Rooker | B01D 19/0047 | 96/206 |
| 6,767,380 B2 * | 7/2004 | von Stackelberg, Jr. | B01D 45/08 | 96/406 |
| 6,997,395 B2 * | 2/2006 | Kawamoto | B08B 3/026 | 134/36 |
| 2018/0020895 A1 * | 1/2018 | Betton | A47L 11/4097 | 15/320 |

FOREIGN PATENT DOCUMENTS

| | | | |
|---|---|---|---|
| JP | H10304993 A * | 11/1998 | |
| WO | WO-2007063452 A2 * | 6/2007 | A47L 11/30 |

OTHER PUBLICATIONS

Translation of JPH10304993A (Year: 1998).*

* cited by examiner

*Primary Examiner* — Tom Rodgers
(74) *Attorney, Agent, or Firm* — Quinn IP Law

(57) ABSTRACT

An assembly including a canister. A vacuum is in fluid communication with the canister. A pump having a pump inlet is in fluid communication with an interior of the canister and a pump outlet is in fluid communication with an exterior of the canister. At least one valve is located fluidly downstream of an outlet of the pump and is configured to circulate fluid within the canister in a first position.

18 Claims, 2 Drawing Sheets

VACUUM ASSEMBLY

BACKGROUND

The present disclosure relates to a vacuum assembly for collecting debris, such as slurry, in a canister or tank.

Traditionally, debris has been collected from a floor surface by a machine with a squeegee and then utilizes suction to draw the debris into a storage tank on the device. The debris includes solid particles, such as cement dust or dirt, that are suspended in a fluid, such as water.

SUMMARY

In one exemplary embodiment, an assembly including a canister. A vacuum is in fluid communication with the canister. A pump having a pump inlet is in fluid communication with an interior of the canister and a pump outlet is in fluid communication with an exterior of the canister. At least one valve is located fluidly downstream of an outlet of the pump and is configured to circulate fluid within the canister in a first position.

In another embodiment according to any of the previous embodiments, the at least one valve is configured to offload fluid from the canister when in a second position through a vacuum assembly outlet.

In another embodiment according to any of the previous embodiments, the at least one valve includes a three-way valve is configured to circulate a fluid within the canister in a first position and discharge a fluid from the canister in a second position.

In another embodiment according to any of the previous embodiments, the assembly includes a canister inlet mixing line in fluid communication with an outlet of the pump and includes an outlet in fluid communication with the canister.

In another embodiment according to any of the previous embodiments, the pump is located within the canister.

In another embodiment according to any of the previous embodiments, a power source for powering the pump and the vacuum is included.

In another embodiment according to any of the previous embodiments, the power source is a generator.

In another embodiment according to any of the previous embodiments, the canister, vacuum pump, and mixing pump are supported by a frame on wheels.

In another embodiment according to any of the previous embodiments, the canister includes a lid having at least one suction line inlet.

In another embodiment according to any of the previous embodiments, the lid includes a vacuum line inlet.

In another embodiment according to any of the previous embodiments, the vacuum line inlet includes a filter housing enclosing a filter.

In another embodiment according to any of the previous embodiments, a vacuum line window is fluidly upstream of the filter housing.

In another embodiment according to any of the previous embodiments, the at least one suction line inlet includes an insert having a plurality of insert perforations.

In another embodiment according to any of the previous embodiments, the vacuum line inlet includes a vacuum line insert having a plurality of vacuum insert perforations.

In another embodiment according to any of the previous embodiments, the plurality of insert perforations are located at least a first distance from the lid. The plurality of vacuum insert perforations are located at least a second distance from the lid. The first distance is greater than the second distance.

In one exemplary method, a method of operating a vacuum assembly. The method includes generating negative pressure within a canister with a vacuum source to draw a fluid within the canister. The fluid within the canister is circulated with a pump while the vacuum source is generating the negative pressure in the canister.

In another exemplary embodiment, the fluid is circulated within the canister by the pump when at least one valve is in a first position and the fluid is discharged from the canister when the at least one valve is in a second position.

In another embodiment according to any of the previous embodiments, circulating the fluid within the canister includes creating a vortex in the fluid within the canister.

In another embodiment according to any of the previous embodiments, at least one valve includes a three-way valve configured to circulate the fluid in a first position and discharge the fluid when in a second position.

In another embodiment according to any of the previous embodiments, the vacuum source, the canister, and the pump are fixed relative to a frame that is movable on wheels relative to a floor surface. At least one floor squeegee is pivotably attached to the frame to move into and out of contact with the floor surface.

BRIEF DESCRIPTION OF THE DRAWINGS

The various features and advantages of the present disclosure will become apparent to those skilled in the art from the following detailed description. The drawings that accompany the detailed description can be briefly described as follows.

DETAILED DESCRIPTION

Figure 1:
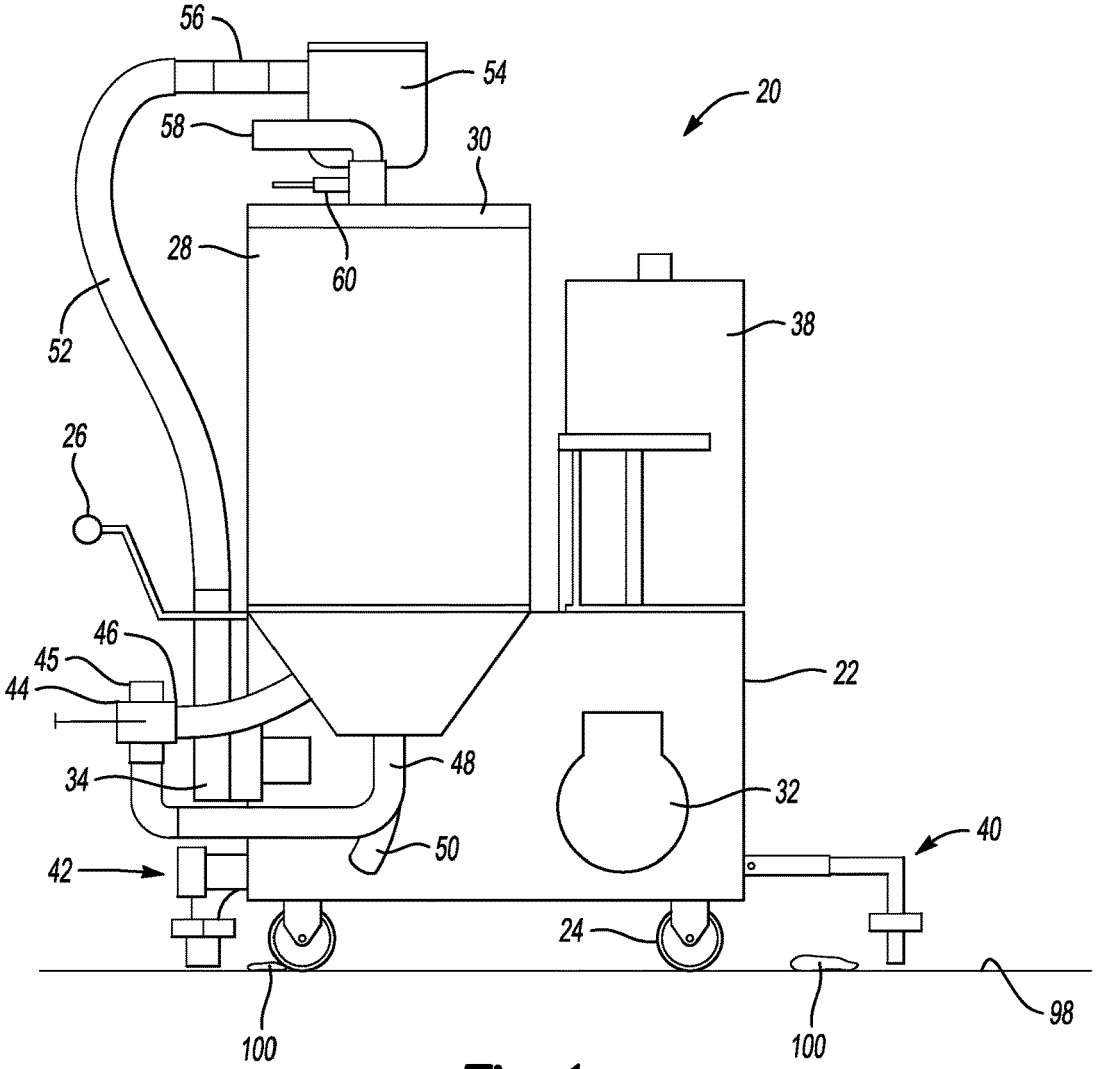
FIG. 1 illustrates an example vacuum assembly.

It is common for debris to be generated during construction processes that must be managed. In particular, debris generated while cement floors are being surfaced by either a grinding or polishing process can generate dust from the cement particles. During the treatment of the cement floors, a floor surface 98 is generally treated with liquid, such as water, to prevent dust from entering the air. When the liquid mixes with cement particles, it creates a material 100, such as a slurry, on a floor surface 98 for removal. One conventional way of removing the material 100 is with a vacuum that is attached to a squeegee that scrapes along the floor surface 98 to direct the material 100 to the vacuum.

A vacuum assembly 20 of the present disclosure aids in collecting the material 100 that collects the floor surface 98. The vacuum assembly 20 includes a frame 22 supported on wheels 24 that allows a user to maneuver the vacuum assembly 20 along the floor surface 98 by engaging a handle 26 on the frame 22. A canister 28, such as a sealable tank, is fixed relative to the frame 22 to collect the material 100 from the floor surface 98. The vacuum assembly 20 also includes a power source 32, such as a generator in communication with a fuel tank 38, to power a vacuum 34, or negative pressure source, configured to create negative pressure within the canister 28 to collect the material 100. An outlet to the vacuum directs the air into a surrounding environment and not into the canister 28. A pump 36 (FIG.

2) is also powered by the power source 32 and is configured to pump the material 100 collected in the canister 28. Alternatively, the vacuum 34 and the pump 36 can be powered by a remote power source through a power cable attached to the vacuum 34 and the pump 36.

In the illustrated example, the vacuum assembly 20 includes a front squeegee 40 pivotally connected to the frame 22 and a rear squeegee 42 that is also pivotally connected to the frame 22. The front and rear squeegees 40, 42 are in fluid communication with an interior of the canister 28 as will be described in greater detail below. A three-way valve 44 includes a valve lever 44A that utilizes the pump 36 to circulate the material 100 within the canister 28 when in a first position by fluidly connecting the canister outlet line 46 to a canister inlet line 48 that is in fluid communication with the canister 28.

When the three-way valve 44 is in a second position, the material 100 within the canister 28 is discharged from the canister 28 through the canister outlet line 46 to an outlet 45 on the three-way valve 44. The material 100 is then collected at a remote location 47 (FIG. 2), such as in a larger container or fluid treatment center that separates the solid particles from the water in the material 100. A drain 50 is also in fluid communication with the canister 28 through the canister inlet line 48 to allow any remaining portion of the material 100 that does not pass through the canister outlet line 46 to be drained from the canister by opening the valve 50V.

Figure 2:
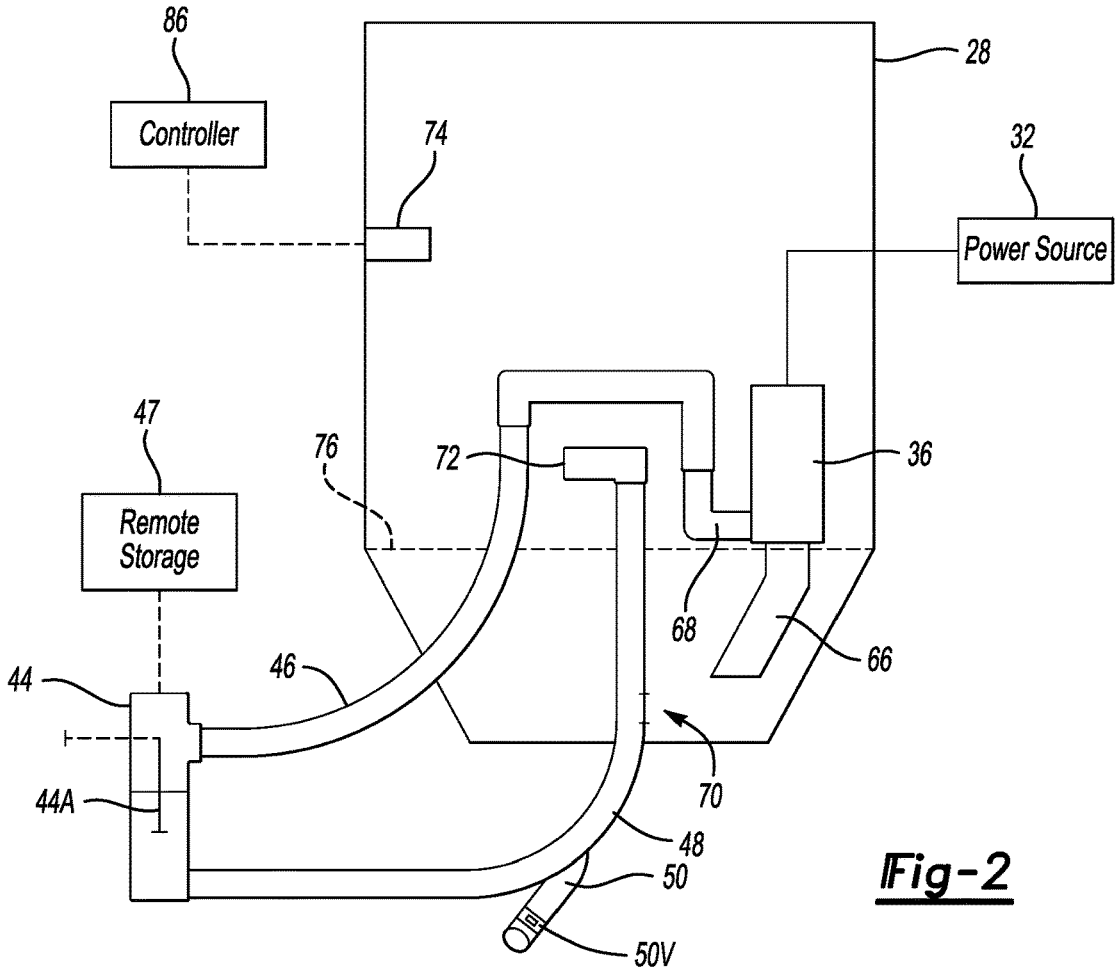
FIG. 2 schematically illustrates a cross-section of a canister of the vacuum assembly of FIG. 1.

FIG. 2 is a schematic cross-sectional view of the canister 28 without the lid and illustrating the pump 36 with the fluid connections. In the illustrated example, the pump 36 circulates the material 100 within the canister 28 by drawing the material 100 into a pump suction line 66 having an inlet located adjacent a bottom of the canister 28, through the pump 36, and out a pump outlet line 68 that is in fluid communication with the canister outlet line 46 that directs the material 100 to the three-way valve 44. While the illustrated examples utilizes the three-way valve 44 to direct the flow of the material 100 being pumped from the canister 28, multiple single valves could also be utilized to direct the flow of the material 100 back into the canister 28 or to the remote location 47.

When the valve lever 44A is in the first position as shown in FIG. 2, the material 100 from the canister 28 is circulated back into the canister 28 to mix the material 100 and prevent sediment from forming at the bottom of the canister 28 or aid in mixing a flocculant into the material 100. The flocculant is a chemical used in the treatment of the material that causes the particles in the material to flocculate and join together and improve the ability of the particles to be separated from the liquid during a filtering or treatment process. When the material 100 returns to the canister 28 through the canister inlet line 48, a vortex opening 70 is located in the canister inlet line 48 adjacent a base of the canister 28 and generates a vortex to within the canister 28. One feature of the vortex, is to provide additional mixing of the material 100 within the canister 28.

Furthermore, in the illustrated example, a vortex nozzle 72 is located at an outlet to the canister inlet line 48 to further mix or create a vortex in the material within the canister 28 when the pump 36 is operational and the three-way valve 44 is in the first position and is circulating the fluid back into the canister 28. The vortex nozzle 72 includes a change in direction from a vertical direction to a horizonal direction and includes an elbow passageway. Also, the canister 28 includes a cylindrical profile to further facilitate the creation of a vortex in the material 100.

Alternatively, the vortex opening 70 and the vortex nozzle 72 may not create a vortex in but increase movement of the material 100 adjacent the bottom of the canister 28 to facilitate mixing. The circulating function of the material 100 within the canister 28 can occur while the vacuum 34 has created negative pressure to draw the material 100 into the canister 28. This allows the continued mixing of the material 100 within the canister 28 even while more material 100 is entering the canister 28.

When the canister 28 is full, a fluid level sensor 74 can be triggered to direct a controller 102 to stop operation of the vacuum 34 to prevent the canister 28 from overfilling. However, the mixing function performed by the pump 36 can continue when the canister 28 is full. In the illustrated example, the controller 102 includes memory and a processor configured to direct the vacuum assembly 20 to operate as discussed in this disclosure.

When the material 100 includes cementitious or other particles suspended within it to form a slurry, the flocculant can be added to the canister in a number of ways. In one example, the flocculant can be introduced into the canister 28 through one of the front or rear squeegees 40, 42. In the illustrated example, a first suction line inlet 58 is in fluid communication with the front squeegee 40 and the canister 28 and a second suction line inlet 62 is in fluid communication with the rear squeegee 42 and the canister 28 to provide passageways for the material 100 and/or the flocculant into the canister 28. The flocculant can also be added by removing the lid 30 of the canister 28 to gain access to the material 100.

Figure 3:
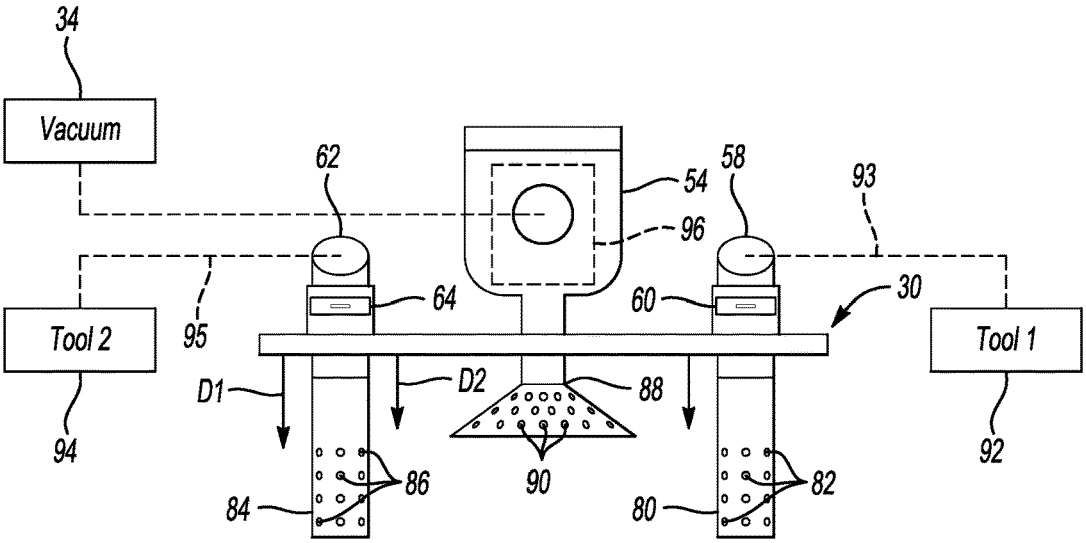
FIG. 3 illustrates a lid for the canister of the vacuum assembly of FIG. 1.

FIG. 3 illustrates the lid 30 of the canister 28 used in the vacuum assembly 20. A filter housing 54 is attached to the lid 30 and encloses a filter 96 to collect any particles or debris that are airborne within the canister 28. The filter housing 54 is fluidly sealed to the lid 30 and connected to the canister 28 through a vacuum insert 88 that extends through the lid 30. The vacuum 34 creates a negative pressure in the canister 28 when the lid 30 is installed by drawing air out of the canister 28 through vacuum insert perforations 90 in the vacuum insert 88. The vacuum insert perforations 90 are located in a cone shaped portion of the vacuum insert 88 and are directed at least partially towards an underside of the lid 30.

Furthermore, as shown in FIG. 1, a canister vacuum line 52 fluidly connects the vacuum 34 with the filter housing 54. The canister vacuum line 52 also includes a window 56 upstream of the filter housing 54 that is transparent to provide for visual inspection of the air traveling through the canister vacuum line 52. This ensures that particles are not bypassing the filter 96 that could damage the vacuum 34 or enter the air surrounding the vacuum assembly 20.

The first suction line inlet 58 on the lid 30 is connectable to a first tool 92, such as the front squeegee 40 or other tool, through a first suction line 93 shown as a dashed line. A valve 60, such a guillotine valve, to selectively fluidly connect the first tool 92 with the canister 28. The first suction line inlet 58 includes a first insert 80 that extends into the canister 28 and includes first perforations 82. A distal end of the first insert 80 is also opened within the canister 28. The first perforations 82 are located at least a distance D1 from an underside of the lid 30 which is greater than a distance D2 of the outermost perforations of the vacuum insert perforations 90 of the vacuum insert 88 to prevent the vacuum 34 from drawing the material 100 out of the canister 28.

Similarly, the lid 30 also includes the second suction line inlet 62 that can be fluidly connected to a second tool 94, such as the rear squeegee 42 or other tool, through a second suction line 95 shown as a dashed line. The second suction line inlet 62 includes a valve 64, such a guillotine valve, to selectively fluidly connect the second tool 94 with the canister 28. Also, a second insert 84 is connected to the second suction inlet and includes a plurality of perforations 86. The perforations 86 are also spaced the at least the distance D1 from the underside of the lid 30 to prevent overlap with the vacuum insert perforations 90. This prevents the material 100 within the canister 28 from being drawn into the vacuum 34.

Figure 4:
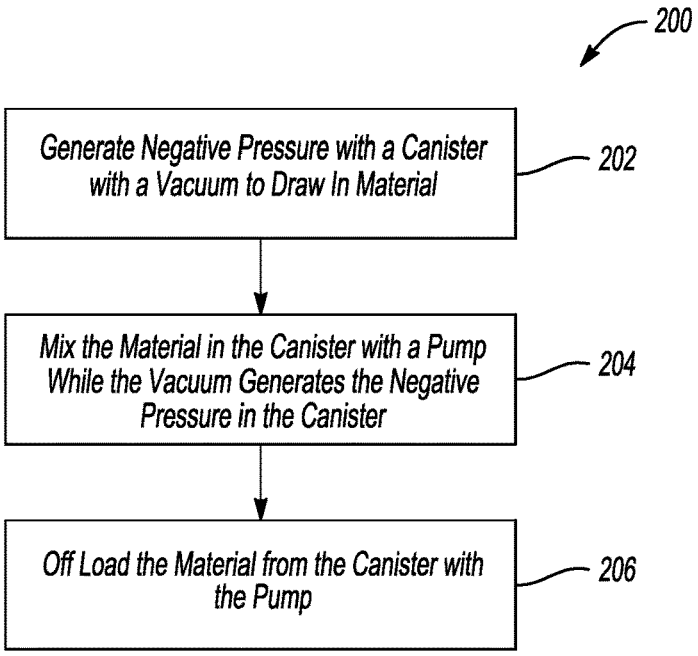
FIG. 4 illustrates an example method of operating the vacuum assembly of FIG. 1.

FIG. 4 illustrates an example method 200 of operating the vacuum assembly 20. The example method 200 includes generating a negative pressure in the canister 28 with the vacuum 34 to draw the material 100 into the canister 28 (Block 202). Once the material 100 is drawn into the canister 28, the material 100 is mixed in the canister 28 with the pump 36 while the negative pressure is generated in the canister 28 by the vacuum 34 (Block 204). The material 100 collected in the canister 28 can then be off loaded from the canister 28 with the pump 36 (Block 206).

Although the different non-limiting examples are illustrated as having specific components, the examples of this disclosure are not limited to those particular combinations. It is possible to use some of the components or features from any of the non-limiting examples in combination with features or components from any of the other non-limiting examples.

It should be understood that like reference numerals identify corresponding or similar elements throughout the several drawings. It should also be understood that although a particular component arrangement is disclosed and illustrated in these exemplary embodiments, other arrangements could also benefit from the teachings of this disclosure.

The foregoing description shall be interpreted as illustrative and not in any limiting sense. A worker of ordinary skill in the art would understand that certain modifications could come within the scope of this disclosure. For these reasons, the following claim should be studied to determine the true scope and content of this disclosure.

What is claimed is:

1. An assembly comprising:

a canister defining an interior volume and including a lid with a vacuum line inlet and at least one suction line inlet extending through the lid, wherein the lid is removably attached to a body portion of the canister and at least partially defines the interior volume;

a vacuum in fluid communication with interior volume of the canister;

a pump having a pump inlet in fluid communication with a pump suction line located within the interior volume of the canister and a pump outlet in fluid communication with a pump outlet line extending through a body portion of the canister to an exterior of the canister, wherein the pump is located within the interior volume of the canister; and at least one valve in fluid communication with the pump outlet line and located fluidly downstream of the pump outlet and the at least one valve is configured to circulate fluid from the pump outlet line through a canister inlet line when in a first position, wherein the canister inlet line extends through the body portion of the canister into the interior volume;

wherein the at least one suction line inlet includes an insert having a plurality of insert perforations and the vacuum line inlet includes a vacuum line insert having a plurality of vacuum insert perforations and the plurality of insert perforations are located at least a first distance from the lid and the plurality of vacuum insert perforations are located at least a second distance from the lid and the first distance is greater than the second distance.

2. The assembly of claim 1, wherein the at least one valve is configured to offload fluid from the canister when in a second position through a vacuum assembly outlet.

3. The assembly of claim 1, wherein the at least one valve includes a three-way valve configured to circulate a fluid within the canister in a first position and discharge a fluid from the canister in a second position.

4. The assembly of claim 1, including a canister inlet mixing line in fluid communication with an outlet of the pump outlet and including an outlet in fluid communication with the canister.

5. The assembly of claim 1, including a power source for powering the pump and the vacuum.

6. The assembly of claim 1, wherein the canister, vacuum pump, and mixing pump are supported by a frame on wheels.

7. The assembly of claim 1, wherein the canister includes the lid having the vacuum line inlet and the at least one suction line inlet in fluid communication with a tool.

8. The assembly of claim 1, including a vortex opening extending through a mid-portion of the canister inlet line and the vortex opening is located adjacent to a base of the canister.

9. The assembly of claim 8, including a drain line in fluid communication with the vortex opening located adjacent to a base of the canister and a drain valve.

10. An assembly comprising:

a canister including a lid with a vacuum line inlet and at least one suction line inlet extending through the lid, wherein the lid is removably attached to a body portion of the canister, wherein the canister defines an interior volume;

a vacuum in fluid communication with the interior volume of the canister;

a pump having a pump inlet in fluid communication with a pump suction line located within the interior volume of the canister and a pump outlet in fluid communication with a pump outlet line extending through a body portion of the canister to an exterior of the canister; and at least one valve in fluid communication with the pump outlet line and located fluidly downstream of the pump outlet and the at least one valve is configured to circulate fluid from the pump outlet line through a canister inlet line when in a first position, wherein the canister inlet line extends through the body portion of the canister into the interior volume and a vortex nozzle is located at a distal end of the canister;

wherein the at least one suction line inlet includes an insert having a plurality of insert perforations and the vacuum line inlet includes a vacuum line insert having a plurality of vacuum insert perforations with the plurality of insert perforations are located at least a first distance from the lid and the plurality of vacuum insert perforations are located at least a second distance from the lid and the first distance is greater than the second distance.

11. The assembly of claim 10, wherein the vacuum line inlet includes a filter housing enclosing a filter and the pump is located within the canister.

12. The assembly of claim 11, including a vacuum line window fluidly upstream of the filter housing.

13. The assembly of claim 10, including a vortex opening extending through a mid-portion of the canister inlet line with the vortex opening located adjacent to a base of the canister and a drain line in fluid communication with the vortex opening located adjacent to a base of the canister and a drain valve.

14. A method of operating a vacuum assembly, the method comprising:

generating negative pressure within a canister with a vacuum source to draw a fluid within an interior volume of the canister, wherein the canister includes a lid removably attached to the canister with a vacuum line inlet and at least one suction line inlet extending through the lid, the lid at least partially defines the interior volume of the canister, the at least one suction line inlet includes an insert having a plurality of insert perforations and the vacuum line inlet includes a vacuum line insert having a plurality of vacuum insert perforations with the plurality of insert perforations are located at least a first distance from the lid and the plurality of vacuum insert perforations are located at least a second distance from the lid and the first distance is greater than the second distance; and circulating the fluid within the canister with a pump while the vacuum source is generating the negative pressure in the canister, wherein the pump is located within the canister and includes a pump inlet in fluid communication with an interior of the canister and a pump outlet in fluid communication with an exterior of the canister and at least one valve is located fluidly downstream of the pump outlet and circulates the fluid within the interior volume of the canister when in a first position through a canister inlet line having a vortex nozzle located at a distal end.

15. The method of claim 14, wherein the fluid is discharged from the canister when the at least one valve is in a second position.

16. The method of claim 15, wherein the canister includes the lid having the vacuum line inlet in fluid communication with the vacuum source and the at least one suction line inlet in fluid communication with a tool.

17. The method of claim 14, wherein at least one valve includes a three-way valve configured to circulate the fluid in a first position and discharge the fluid when in a second position.

18. The method of claim 14, wherein the vacuum source, the canister, and the pump are fixed relative to a frame that is movable on wheels relative to a floor surface and at least one floor squeegee is pivotably attached to the frame to move into and out of contact with the floor surface.

* * * * *